US010246232B2

(12) United States Patent
Johnson et al.

(10) Patent No.: US 10,246,232 B2
(45) Date of Patent: Apr. 2, 2019

(54) SEPTA

(71) Applicant: SAINT-GOBAIN PERFORMANCE PLASTICS CORPORATION, Solon, OH (US)

(72) Inventors: Scott Richard Johnson, Troy, NY (US); Daniel Salvatore Montuori, Niskayuna, NY (US)

(73) Assignee: SAINT-GOBAIN PERFORMANCE PLASTICS CORPORATION, Solon, OH (US)

( * ) Notice: Subject to any disclaimer, the term of this patent is extended or adjusted under 35 U.S.C. 154(b) by 0 days.

(21) Appl. No.: 15/466,526

(22) Filed: Mar. 22, 2017

(65) Prior Publication Data

US 2017/0190484 A1 Jul. 6, 2017

Related U.S. Application Data

(63) Continuation of application No. 14/301,996, filed on Jun. 11, 2014, now Pat. No. 9,624,015, which is a (Continued)

(51) Int. Cl.
*B65D 53/00* (2006.01)
*B01L 3/00* (2006.01)
(Continued)

(52) U.S. Cl.
CPC ..... *B65D 53/00* (2013.01); *B01L 3/508* (2013.01); *B01L 3/50825* (2013.01);
(Continued)

(58) Field of Classification Search
CPC ..... B01L 3/50825; B01L 3/508; B01L 2200/025; B01L 2300/123; B01L 2300/16;
(Continued)

(56) References Cited

U.S. PATENT DOCUMENTS 2,387,955 A 10/1945 Tilson
2,783,908 A * 3/1957 Leslie ..... B65D 39/00 215/247
(Continued)

FOREIGN PATENT DOCUMENTS

EP 1435254 7/2004
FR 1077767 A 11/1954
(Continued)

OTHER PUBLICATIONS

Definition of the word "annular." Random House Dictionary. 2011. http://www.dictionary.com.
(Continued)

*Primary Examiner* — James N Smalley
(74) *Attorney, Agent, or Firm* — Abel Law Group, LLP; Chi Suk Kim

(57) ABSTRACT

A system includes a cap having an opening, and a septum configured to engage with the cap. The septum includes a first portion having a first width, and a second portion having a second width smaller than the first width. The second portion is sized and shaped to be received by the opening of the cap.

20 Claims, 5 Drawing Sheets

Related U.S. Application Data continuation of application No. 11/848,626, filed on Aug. 31, 2007, now Pat. No. 8,783,484.

(51) Int. Cl.
*B65D 51/00* (2006.01)
*B67B 1/04* (2006.01)
*B65D 41/04* (2006.01)

(52) U.S. Cl.
CPC ..... *B65D 41/04* (2013.01); *B65D 51/002* (2013.01); *B67B 1/04* (2013.01); *B01L 2200/025* (2013.01); *B01L 2300/042* (2013.01); *B01L 2300/044* (2013.01); *B01L 2300/123* (2013.01); *B01L 2300/16* (2013.01)

(58) Field of Classification Search
CPC ..... B01L 2300/042; B01L 2300/044; B65D 53/00; B65D 51/002; B67B 1/04
USPC ..... 215/45, 247, 249, 320, 355, 356, 360, 215/364, 276; 220/319, 801, DIG. 19; 604/415
See application file for complete search history.

(56) References Cited

U.S. PATENT DOCUMENTS

| | | | | |
|---|---|---|---|---|
| 3,499,568 | A * | 3/1970 | Riera | B65D 51/002 215/247 |
| 3,709,395 | A | 1/1973 | Brennan et al. | |
| 4,176,755 | A | 12/1979 | Winchell | |
| 4,446,980 | A | 5/1984 | Oliver et al. | |
| 4,531,651 | A | 7/1985 | Donnelly | |
| 4,747,499 | A | 5/1988 | Gach et al. | |
| 4,747,500 | A | 5/1988 | Gach et al. | |
| 4,936,498 | A | 6/1990 | Pirila | |
| 4,993,573 | A | 2/1991 | Freidel et al. | |
| 5,370,252 | A | 12/1994 | Parsons et al. | |
| 5,484,566 | A | 1/1996 | Gabbard | |
| 5,555,988 | A | 9/1996 | Koch et al. | |
| 6,006,932 | A | 12/1999 | Morini | |
| 6,024,235 | A | 2/2000 | Schwab | |
| 6,277,331 | B1 * | 8/2001 | Konrad | B01L 3/50215 210/516 |
| 8,783,484 | B2 | 7/2014 | Johnson et al. | |
| 2004/0141886 | A1 | 7/2004 | Py et al. | |
| 2004/0217081 | A1 | 11/2004 | Konrad | |
| 2005/0191508 | A1 | 9/2005 | McEntee | |
| 2014/0291276 | A1 | 10/2014 | Johnson et al. | |

FOREIGN PATENT DOCUMENTS

| | | | |
|---|---|---|---|
| JP | S62-287859 | A | 12/1987 |
| JP | H01503446 | A | 11/1989 |
| JP | H05-46458 | Y2 | 12/1993 |
| JP | H09-206357 | A | 8/1997 |
| JP | 2002-028219 | A | 1/2002 |
| NO | 2009032078 | A1 | 3/2009 |

OTHER PUBLICATIONS

International Search Report and Written Opinion dated Jan. 13, 2009 issued in PCT Application No. PCT/US2008/009954, 12 pages.

* cited by examiner

SEPTA

CROSS-REFERENCE TO RELATED APPLICATIONS

This application claims priority under 35 U.S.C. § 120 to and is a continuation of U.S. patent application Ser. No. 14/301,996 entitled "Septa," by Johnson et al., filed Jun. 11, 2014, which application claims priority under 35 U.S.C. § 120 to and is a continuation of U.S. patent application Ser. No. 11/848,626, now U.S. Pat. No. 8,783,484, entitled "Septa," by Johnson et al., filed Aug. 31, 2007, of which both applications are assigned to the current assignee hereof and incorporated herein by reference in their entireties.

TECHNICAL FIELD

The invention relates to septa.

BACKGROUND

Septa are barriers used to prevent contamination between a vessel's contents and the vessel's exterior environment. For example, to prevent contamination (e.g., degradation) of an oxygen- and/or moisture-sensitive material contained in a flask or a bottle, a septum in the form of a stopper can be used to seal the mouth of the flask or the bottle. The septum can also be used, for example, to seal a vessel containing a hazardous material, thereby preventing accidental spillage of the hazardous material.

Septa can include an elastomeric material (such as rubber) that can be repeatedly punctured by a needle or a cannula. When a septum is punctured, for example, by a needle, compressed elastomeric material can create a seal around the needle as the needle is used to transfer material (e.g., a fluid) into or out of a vessel. When the needle is withdrawn from the septum, the compressed material forces the puncture closed and reseals the vessel. As a result, material can be transferred into and out of the vessel with reduced or no substantial contamination.

SUMMARY

The invention relates to septa and systems including septa.

In one aspect, the invention features a system including a cap having an opening; and a septum configured to engage with the cap. The septum includes a first portion having a first width, and a second portion having a second width smaller than the first width. The second portion is sized and shaped to be received by the opening of the cap.

In another aspect, the invention features a septum configured to engage with a cap having an opening the cap. The septum includes a first portion having a first width, and a second portion having a second width smaller than the first width. The second portion is sized and shaped to be received by the opening of the cap.

Embodiments may include one or more of the following features. The septum further includes a third portion having a third width larger than the second width. At least one of the first width or the third width is larger than a width of the opening of the cap. The second portion is between the first portion and the third portion. The second portion has a thickness substantially equal to or greater than a thickness of the cap. The septum includes an elastomeric material. The septum further includes a third portion having a chemical composition (such as polytetrafluoroethylene) different than a chemical composition (such as an elastomeric material) of the first portion or the second portion. The first width is larger than a width of the opening of the cap, and the first portion is resiliently deformable and passable through the opening of the cap. The septum further includes a third portion having a third width larger than the second width, the second portion is between the first portion and the third portion, the first width is larger than a width of the opening of the cap, and the first portion is resiliently deformable and passable through the opening of the cap. The septum further includes a fourth portion having a chemical composition different than a chemical composition of the first, second or third portion.

The system can further include a vessel. The vessel can be configured to engage with the cap, wherein the vessel has a lip, and the septum is sized and shaped to contact and to seal the lip when the vessel and the cap are engaged. The vessel can be configured to engage with the cap, wherein the vessel has an inner surface, and the septum is sized and shaped to contact and to seal the inner surface when the vessel and the cap are engaged. The vessel can be configured to engage with the cap, wherein the septum includes an outer contour substantially matching a contour of the vessel.

Other aspects and features will be apparent from the description of the embodiments thereof and from the claims.

DETAILED DESCRIPTION

Figure 1:
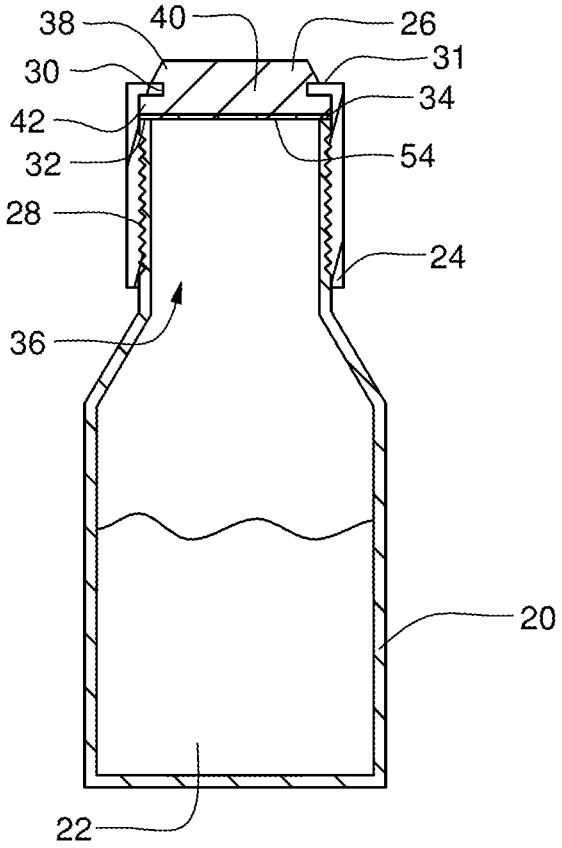
FIG. 1 is a diagrammatic view of an embodiment of a sealed vessel.

FIG. 1 shows a vessel 20 containing a fluid 22 sealed within the vessel with a cap 24 and an elastomeric septum 26. Cap 24 is capable of engaging with vessel 20 by a twist-on threaded connection 28 that secures septum 26 between the cap and the vessel. More specifically, cap 24 has an opening 30 on its top wall 31 through which septum 26 is inserted, and as described below, the septum has structural features that allow it to remain attached to the cap. When cap 24 is twisted on vessel 20, septum 26 is securely compressed between the cap and the vessel, thereby sealing a mouth 36 of the vessel. As shown, septum 26 has a bottom portion 32, vessel 20 has a lip 34, and the bottom portion and the lip contact and press together to form a fluid-tight seal.

In use, septum 26 serves as a barrier to prevent contamination between fluid 22 and the exterior environment. For example, if fluid 22 is oxygen- and/or moisture-sensitive, septum 26 can prevent contamination (e.g., degradation) of the fluid, and/or if the fluid is hazardous, the septum can prevent accidental spillage of the fluid. Fluid 22 can be withdrawn from vessel 20 and/or material can be placed in the vessel by puncturing septum 26 with a sharp tube, such as a needle or a cannula. When septum 26 is punctured, compressed elastomeric material of the septum can create a seal around the tube as the tube is used to transfer material into or out of vessel 20. When the tube is withdrawn from septum 26, the resiliently compressed material forces the puncture closed and reseals vessel 20. As a result, material can be transferred into and out of vessel 20 with reduced or no substantial contamination. When a septum needs to be replaced, it is removed from the cap, and another septum can be attached to the cap, which can be re-used.

Figure 2A:
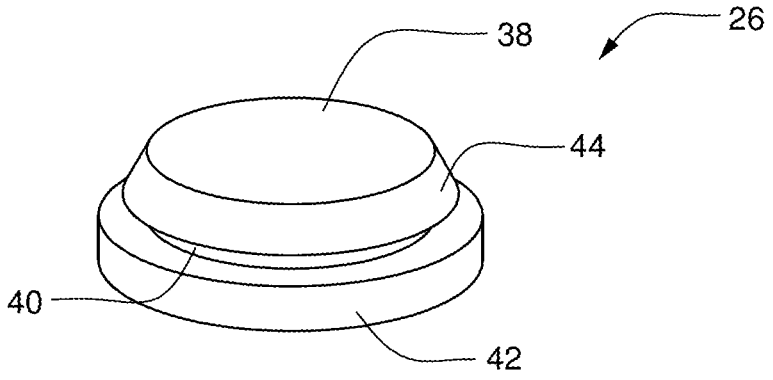
FIG. 2A is a perspective view of an embodiment of a septum.
Figure 2B:
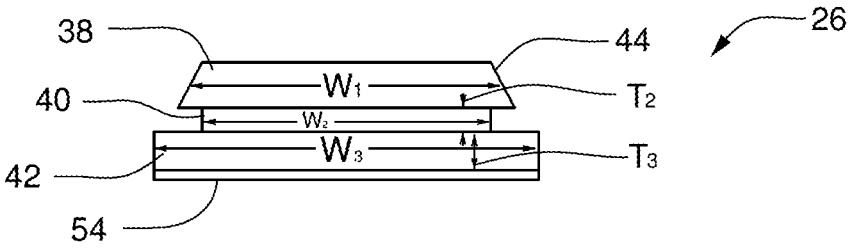
FIG. 2B is a side view of the septum of FIG. 2A.

Septum 26 is designed to be inserted through opening 30 of cap 24, to remain attached to the cap, and to engage with vessel 20 to form a seal. Referring also to FIGS. 2A and 2B, septum 26 includes three unitarily formed portions: a first portion 38, a second portion 40, and a third portion 42 having widths W1, W2, and W3, respectively. As used herein, the width is the average width of a portion, and for a generally circular portion, the width is the average diameter of the generally circular portion.

Figure 3A:
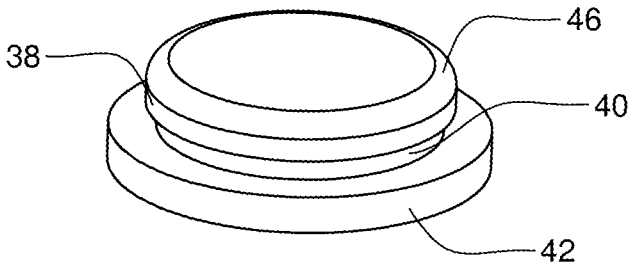
FIG. 3A is a perspective view of an embodiment of a septum.
Figure 3B:
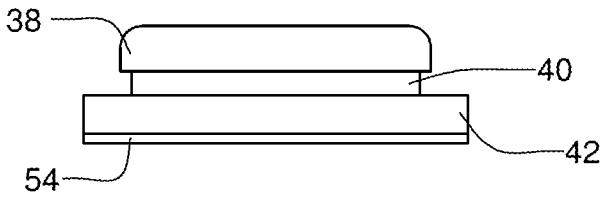
FIG. 3B is a side view of the septum of FIG. 3A.

First portion 38 is configured to be passed from a first side (e.g., inner side) of cap 24, through opening 30 of the cap, and to a second side (e.g., outer side) of the cap. To help first portion 38 stay mechanically in place, the first portion can include at least one width that is larger than a width or a diameter of opening 30. At the same time, the width of first portion 38 is sufficient to allow the first portion to be passed through opening 30. In use, first portion 38 is resiliently deformed to insert it through opening 30, and thereafter allowed to spring back to its non-deformed shape. To assist with the insertion, first portion 38 can include a chamfered or tapered wall portion 44, as shown in FIG. 2B. In other embodiments, referring to FIGS. 3A and 3B, first portion 38 includes a rounded wall portion (e.g., an edge and/or a corner) 46 to help ease insertion through opening 30.

Second portion 40 is located between first and third portions 38, 42 and configured to engage with opening 30 of cap 24. As shown, the width ($W_2$) of second portion 40 is smaller than the widths ($W_1$, $W_3$) of first and third portions 38, 42. The width ($W_2$) of second portion 40 can be less than, equal to, or greater than the width of opening 30. For example, the width ($W_2$) of second portion 40 can be greater than the width of opening 30 such that the second portion can extend through opening and compress against portions of cap 24 that define the opening, thereby helping to secure septum 26 to the cap. In some embodiments, the width ($W_2$) of second portion 40 is approximately 0.010-0.015 inch larger than the width of opening 30. Referring to FIG. 2B, the thickness ($T_2$) of second portion 40 can be less than, equal to, or greater than the thickness of top wall 31 of cap 24. In embodiments in which the thickness ($T_2$) of second portion 40 is less than or equal to the thickness of top wall 31, septum 26 is deformable (e.g., flexible) so that portions of the top wall can be placed between the first and third portions 38, 42.

Figure 4A:
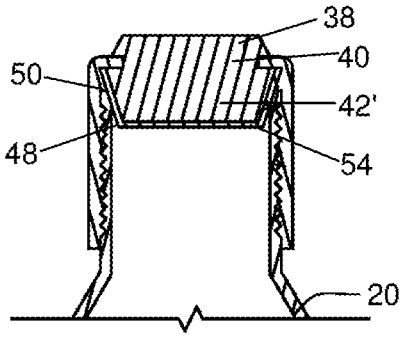
FIG. 4A is a partial, diagrammatic view of an embodiment of a sealed vessel.
Figure 4B:
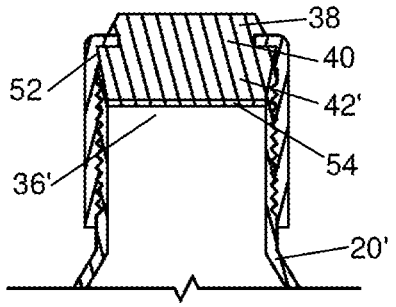
FIG. 4B is a partial, diagrammatic view of an embodiment of a sealed vessel.
Figure 4C:
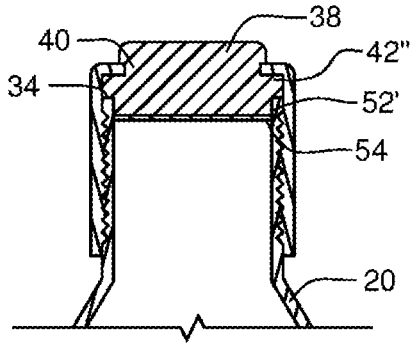
FIG. 4C a partial, diagrammatic view of an embodiment of a sealed vessel.

Third portion 42 is configured to help septum 26 stay in place and to form a seal with vessel 20. To help septum 26 stay mechanically in place, third portion 42 can include at least one width that is larger than a width or a diameter of opening 30, while still allowing the third portion to be placed between cap 24 and vessel 20, e.g., in an interior volume of the cap. In some embodiments, the width (W3) of third portion 42 is approximately 0.010-0.015 inch larger than the width of the interior volume of cap 24 where the third portion is positioned, thereby providing a pressed fit. The thickness (T3) of third portion 42 is selected to allow cap 24 to engage with vessel 20 such that the third portion can be compressed to form a tight seal with the vessel. To form the seal with vessel 20, third portion 42 can be pressed against lip 34 of the vessel, as shown in FIG. 1. In other embodiments, third portion 42 can be pressed against other portions of vessel 20. For example, referring to FIG. 4A, third portion 42' can have a tapered outer contour 48, similar to a rubber stopper, that compresses against an edge 50 of vessel 20 to form a seal. In some embodiments, referring to FIG. 4B, vessel 20' includes an inner surface contour 52 that substantially matches outer contour 48 of third portion 42'. As a result, third portion 42' can be wedged into mouth 36' of vessel 20' to form a tight seal. In still other embodiments, referring to FIG. 4C, third portion 42" can compress against both lip 24 and an inner surface contour 52' of vessel 20 to form a tight seal. The inner surface contour of vessel 20 and outer contour of third portion 42" can be tapered and wedged together to form a seal, similar to the seal shown in FIG. 4B.

In some embodiments, referring back to FIG. 2B, for example, septum 24 includes a fourth portion 54 provided to enhance the chemical stability of the septum. For example, a vessel can contain a material that can react with a material included in septum 24, which can lead to contamination. By coating selected portions of septum 24 that can contact material in a vessel with an inert material, such contamination can be reduced. Examples of materials for fourth portion 54 include polytetrafluoroethylene (PTFE), polypropylene, biaxially-oriented polypropylene (BOPP), high density polyethylene (HDPE), and fluorinated ethylene-propylene (FEP). In some embodiments, the entire outer surface of septum 26 can be applied with an inert material included in fourth portion 54.

Septum 26 can include (e.g., is formed of) any material capable of being repeatedly punctured with no or little coring, and capable of resealing the punctures. Examples of materials include elastomers, such as rubbers (e.g., butyl rubbers), LIM 6040™ (a two-component, liquid silicone rubber available from General Electric), and heat-cured rubber (HCR).

Septum 26 can be fabricated by conventional techniques, such as injection molding and compression molding. In embodiments in which septum 26 includes fourth portion 54, the material in fourth portion can be placed in a mold prior to injecting the material for the septum. Fourth portion 54 can also be applied after septum 26 is fabricated.

Figure 5:
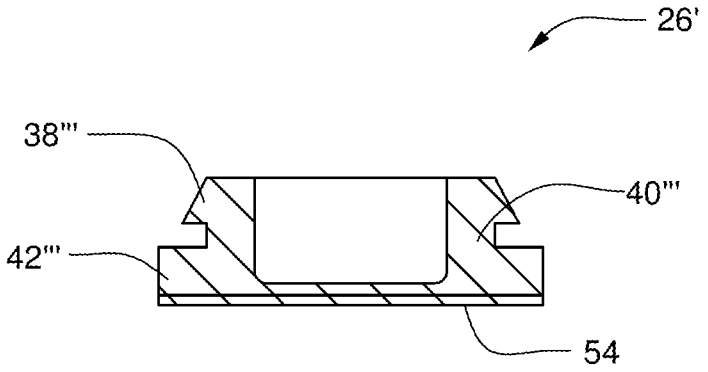
FIG. 5 is cross-sectional, diagrammatic view of an embodiment of a septum.

While a number of embodiments have been described, the invention is not so limited. As an example, portions 38, 40, 42 of septum 26 can be wholly solid, or in some embodiments, one, two, or three of these portions can be substantially hollow or partially hollow. For example, second portion 40 and third portion 42 can have an annular shape with a hollow center portion, and first portion 38 can be the only portion that provides a barrier between a vessel's contents and the external environment. FIG. 5 shows a septum 26' including a first portion 38''', a second portion 40''', and a third portion 42''', in which the first and second portions each have a thickness that is wholly hollow, and the third portion has a thickness that is partially hollow. As a result, when septum 26' is used, third portion 42''' serves as a barrier between a vessel's contents and the external environment. Reducing the amount of material in septum 26 can reduce cost and ease insertion of hollow tube through the septum.

While FIG. 1 shows third portion 42 contacting a flat surface of cap 24, in some embodiments, the cap includes threads at portions that contact the third portion. The threads can bite into deformable third portion 42 to further secure the septum to the cap.

One or more portions of a septum (e.g., portion 38, 40, and/or 42) can have a non-circular shape. For example, one or more portions can have a regular or an irregular polygonal shape having three, four, five, six, seven, eight or more sides. The opening of the cap and/or the mouth (e.g., lip) of the vessel can be modified accordingly to engage with the septum.

The cap can engage with the vessel by other than a threaded connection. For example, the cap can be crimped to the vessel, snap fitted to the vessel, or interference fitted to the vessel.

The cap can have a non-circular shape, e.g., a polygonal shape having straight and/or curved sides for easy gripping.

The cap can have a non-circular opening, and the portion of the septum that extends through the opening can be sized and shaped accordingly.

Other embodiments are within the scope of the following claims.

What is claimed is:

1. A system comprising:

a cap comprising an opening; and a septum configured to engage with the cap, the septum comprising:

an annular shaped first portion having a first width, wherein the first portion comprises a rounded-wall portion;

a second portion having a second width smaller than the first width, the second portion being sized and shaped to be received by the opening of the cap;

a third portion adjacent the second portion, the third portion having a third width larger than the first width and the second width, wherein the third portion has a constant circumferential width from a top surface to a bottom surface of the third portion, wherein the bottom surface has a constant horizontal plane across the circumferential width of the third portion; and an inert coating disposed on the bottom surface of the third portion defining a terminal end of the septum.

2. The system of claim 1, wherein at least one of the first width or the third width is larger than a width of the opening of the cap.

3. The system of claim 1, wherein the second portion is between the first portion and the third portion.

4. The system of claim 1, wherein the second portion has a thickness substantially equal to or greater than a thickness of the cap.

5. The system of claim 1, wherein at least the first portion, the second portion, or the third portion comprises an elastomeric material.

6. The system of claim 5, wherein the elastomeric material comprises silicone.

7. The system of claim 1, wherein the inert coating comprises polytetrafluoroethylene, polypropylene, biaxially-oriented polypropylene, high density polyethylene, or fluorinated ethylene-propylene.

8. The system of claim 1, wherein the first width is larger than a width of the opening of the cap, and the first portion is resiliently deformable having the rounded wall portion to be passable through the opening of the cap.

9. The system of claim 1, wherein at least the first portion, the second portion, or the third portion have a thickness that is at least partially hollow.

10. The system of claim 1, further comprising a vessel configured to engage with the cap.

11. The system of claim 10, wherein the septum is configured for puncture for fluid movement through the septum and to the vessel, from the vessel, or combination thereof.

12. The system of claim 10, wherein the vessel has an inner surface and the septum is sized and shaped to contact and to seal the inner surface when the vessel and the cap are engaged.

13. The system of claim 12, wherein the inner surface of the vessel has a contour that substantially matches the outer contour of the third portion to form the seal when the vessel and the cap are engaged.

14. The system of claim 12, wherein the vessel has a lip having an upper surface, and the third portion of the septum includes a portion that compresses against the lip when the vessel and the cap are engaged.

15. The system of claim 14, wherein the third portion of the septum includes a horizontal lower surface sized and shaped to compress against the upper surface of the lip of the vessel and form the seal.

16. The system of claim 1, wherein the second and third portions are annular in shape.

17. A method of inserting the elastomeric septum of claim 1 into a cap opening, the method comprising:

deflecting the walls of the annular shaped portion of the septum inwardly to allow the portion to pass through the cap opening;

pressing the annular shaped portion of the septum through the cap opening; and allowing the annular shaped portion to expand back to its original shape after passing through the cap opening.

18. The method of claim 17, wherein the third portion of the septum provides a stop to prevent pressing the septum completely through the cap opening.

19. A system comprising:

a cap comprising an opening;

a septum configured to engage with the cap, the septum comprising:

an annular shaped first portion having a first width, wherein the first portion comprises a rounded-wall portion;

a second portion having a second width smaller than the first width, the second portion being sized and shaped to be received by the opening of the cap;

a third portion adjacent the second portion, the third portion having a third width larger than the first width and the second width, wherein the third portion has a constant circumferential width from a top surface to a top surface to a bottom surface of the third portion, wherein the bottom surface has a constant horizontal plane across the circumferential width of the third portion; and an inert coating disposed on the bottom surface of the third portion defining a terminal end of the septum; and a vessel configured to engage with the cap, wherein the septum is configured for puncture for fluid movement through the septum and to the vessel, from the vessel, or combination thereof.

20. The system of claim 19, wherein the vessel has an inner surface and the septum is sized and shaped to contact and to seal the inner surface when the vessel and the cap are engaged.

* * * * *